US005361474A

United States Patent [19]

Yang

[11] Patent Number: 5,361,474

[45] Date of Patent: Nov. 8, 1994

[54] RIVETER

[76] Inventor: Ah-Mi Yang, P.O. Box 65-76, Taichung, Taiwan, Prov. of China

[21] Appl. No.: 186,318

[22] Filed: Jan. 25, 1994

[51] Int. Cl.[5] ..... B21J 15/34

[52] U.S. Cl. ..... 29/243.528; 29/243.527; 72/391.2

[58] Field of Search ..... 29/243.527, 243.528; 72/391.2, 391.4

[56] References Cited

U.S. PATENT DOCUMENTS 3,760,627 9/1973 Richardson et al. ..... 29/243.527
4,344,311 8/1982 Inoue ..... 72/391.2
4,552,010 11/1985 Hein ..... 29/243.528

FOREIGN PATENT DOCUMENTS 0100936 6/1983 Japan ..... 29/243.521

*Primary Examiner*—David Jones

[57] ABSTRACT

A riveter includes a handle, a chuck coupled to the handle, a casing secured to the body, a seat extended from the casing, a chamber formed in the seat for slidably receiving the chuck, and a disc rotatably secured to the seat, two or more mouths of different size are disposed in the disc, either of the mouths can be aligned with the chuck when the disc is rotated such that mouths of different sizes can be easily aligned with the chuck for drawing rivets of different sizes.

2 Claims, 6 Drawing Sheets

RIVETER

BACKGROUND OF THE INVENTION

1. Field of the Invention

The present invention relates to a riveter, and more particularly to a riveter having a mechanism for changing different sizes in order to operate rivets of different sizes.

2. Description of the Prior Art

A typical riveter is shown in FIG. 6 and comprises a body 1 having a handle 2 pivotally coupled thereto, a head 11 extended from the body 1, a mouth 12 secured to the head, three spare mouths 12 secured to the body 1, the mouths 12 have different sizes for engaging rivets of different sizes, and a chuck 21 slidably received in the head 11 for drawing the rivets engaged in the mouths 12; however, in order to change the mouths 12, the first mouth 12 engaged on the head 11 has to be unthreaded first, and a second mouth of right size is then unthreaded and threaded again to the head 11, the first mouth 12 is then threaded to the place where the second mouth 12 is engaged previously. This is inconvenient.

The present invention has arisen to mitigate and/or obviate the afore-described disadvantages of the conventional riveters.

SUMMARY OF THE INVENTION

The primary objective of the present invention is to provide a riveter in which the mouths can be easily changed in order to draw rivets of different sizes.

In accordance with one aspect of the invention, there is provided a riveter comprising a body including a first end and a second end, a handle including a first end pivotally coupled to the first end of the body and including a second end movable toward or away from the body, a chuck coupled to the first end of the handle, a casing secured to the first end of the body and including a seat extended therefrom, the seat including a chamber :formed therein for slidably receiving the chuck, a disc rotatably secured to the seat and including at least two mouths provided therein, either of the mouths being aligned with the chuck when the disc is rotated.

The seat includes a projection disposed therein, the disc includes at least two cavities formed therein for engaging with the projection such that the disc is retained in position relative to the seat.

The seat further includes an annular groove formed therein and communicated with the chamber, the mouths are engaged in the annular groove for aligning with the chuck.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
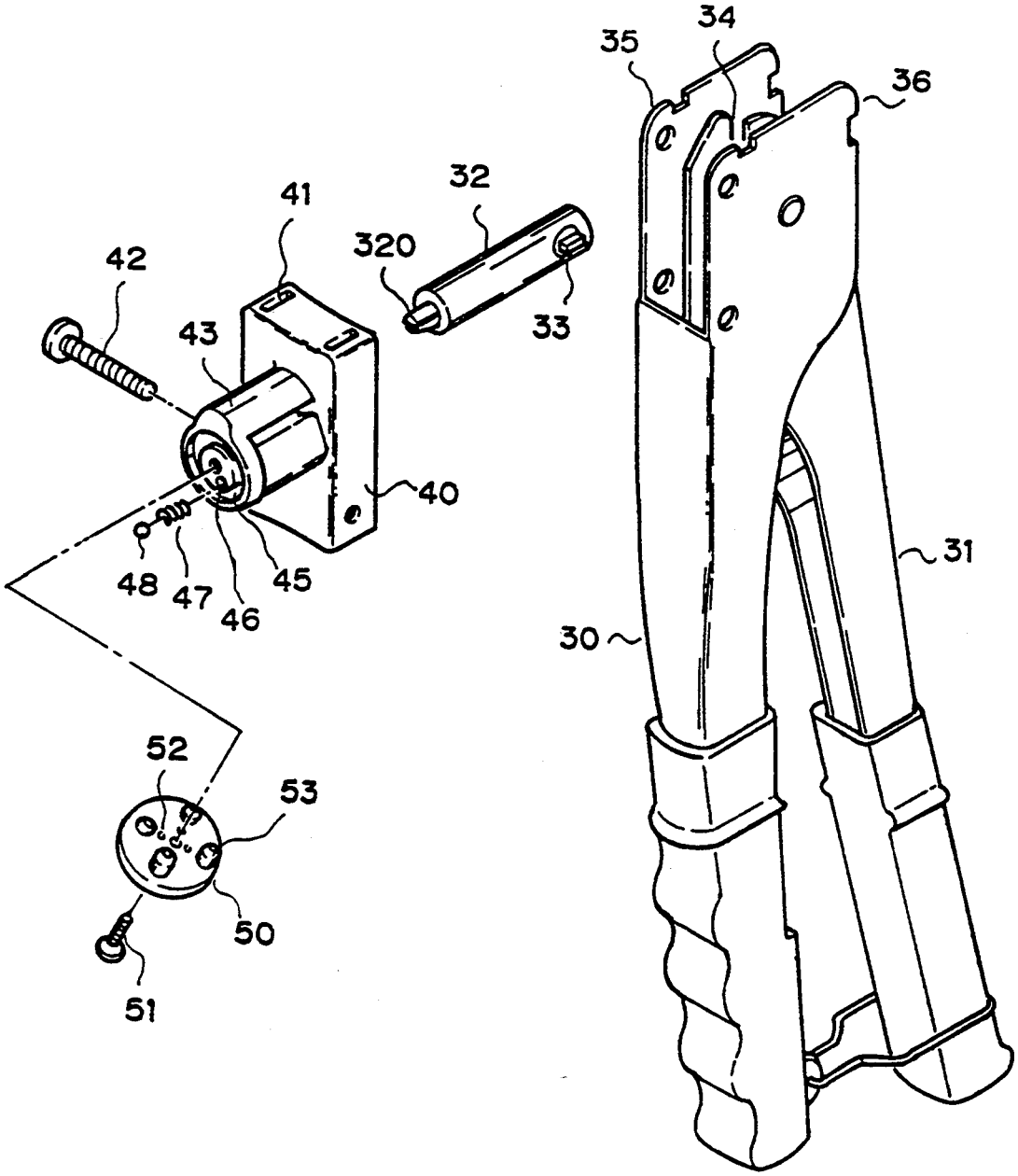
FIG. 1 is an exploded view of a riveter in accordance with the present invention.
Figure 2:
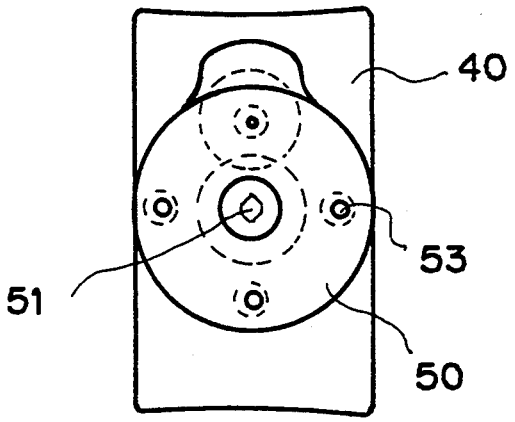
FIG. 2 is a plane view of the disc.
Figure 3:
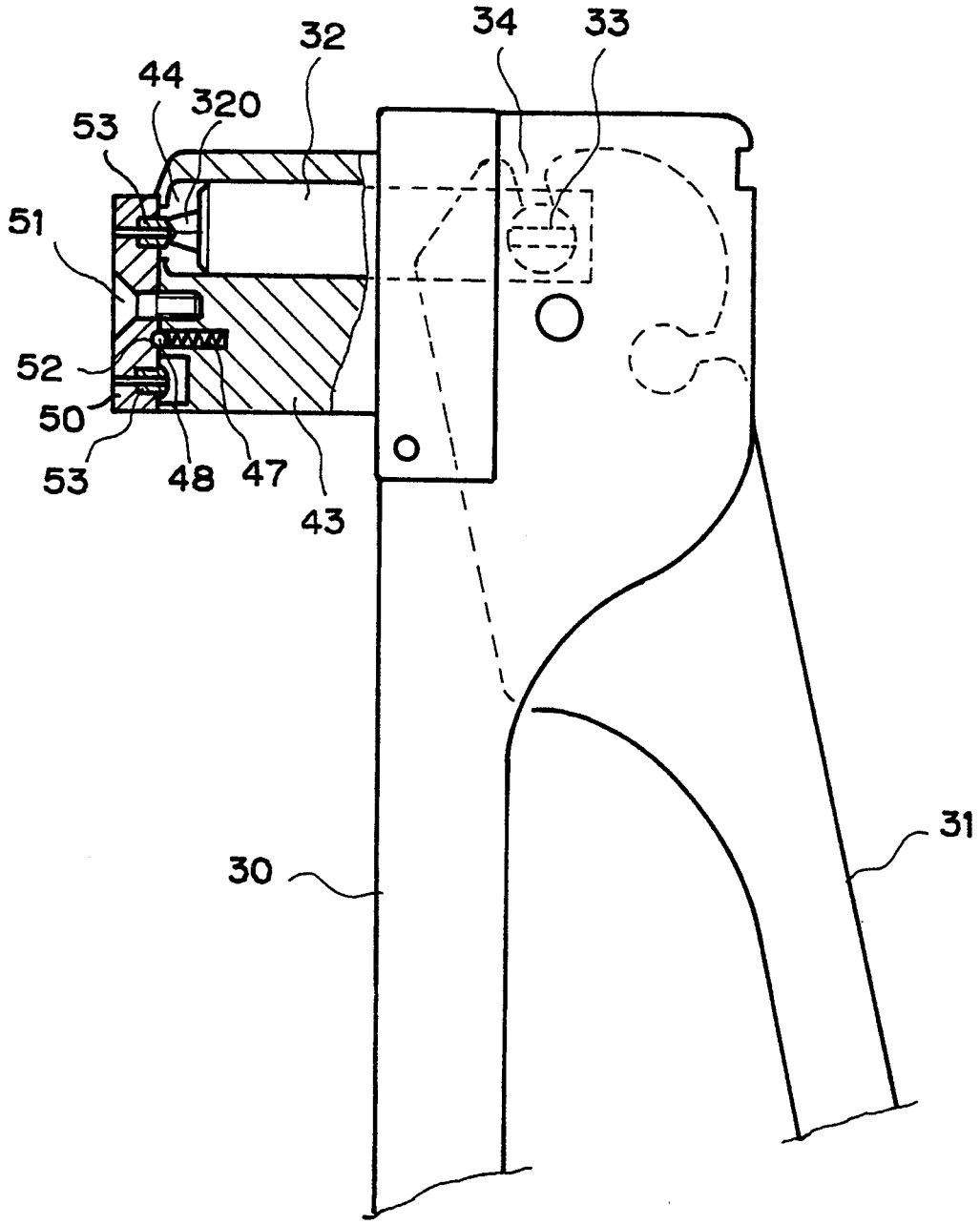
FIGS. 3 and 4 are partial cross sectional views illustrating the operation of the riveter.

Referring to the drawings, and initially to FIGS. 1 to 3, a riveter in accordance with the present invention comprises a body 30, a handle 31 pivotally coupled to the body 30, a chuck 32 including two stubs 33 laterally extended therefrom for engaging with either pair of two pairs of notches 34 formed in the handle 31 such that the chuck 32 can be operated when the handle 31 moves toward or away from the body 30, the mechanism as described above is conventional and will not be described in further details.

Figure 4:
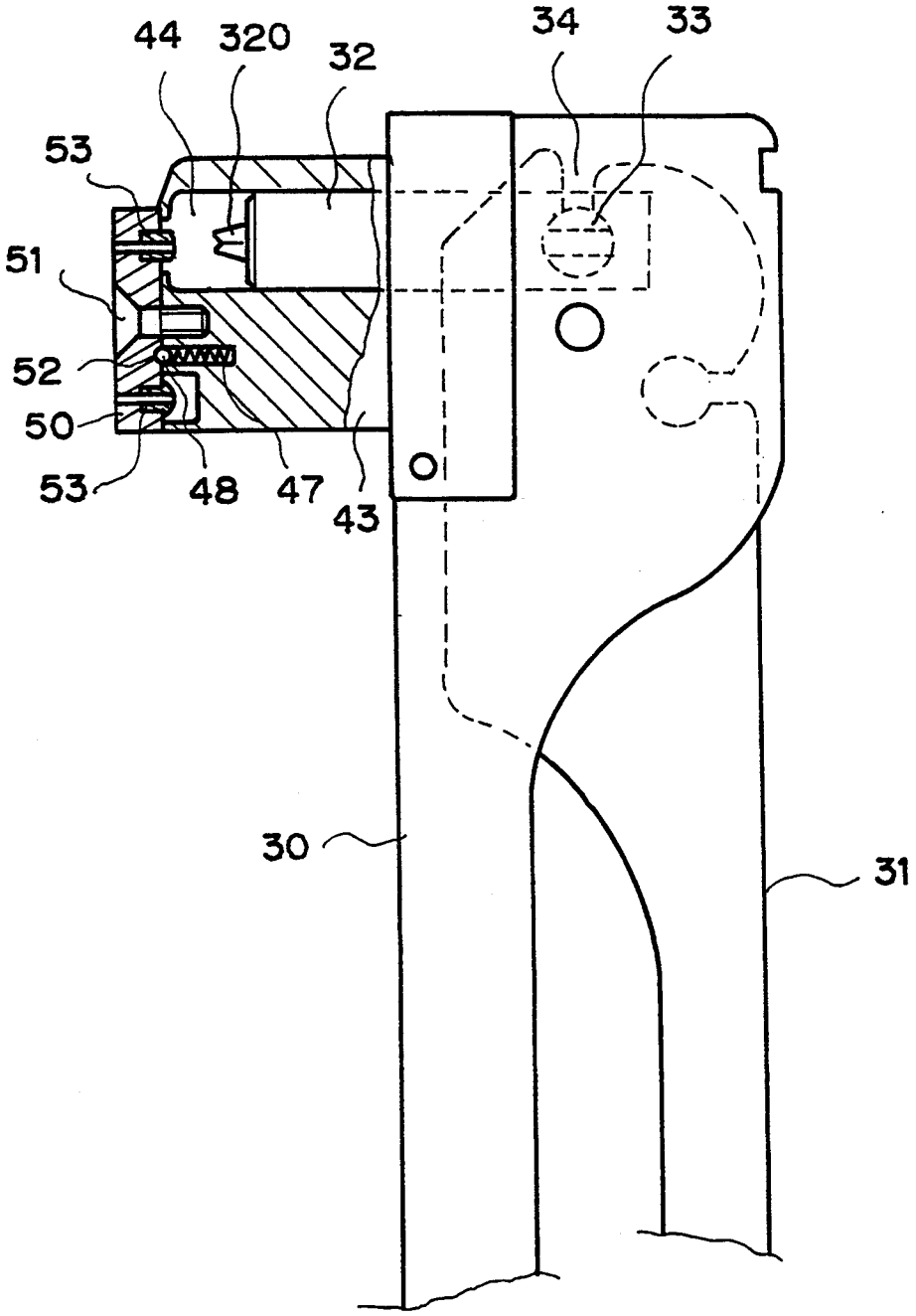
Figure 5:
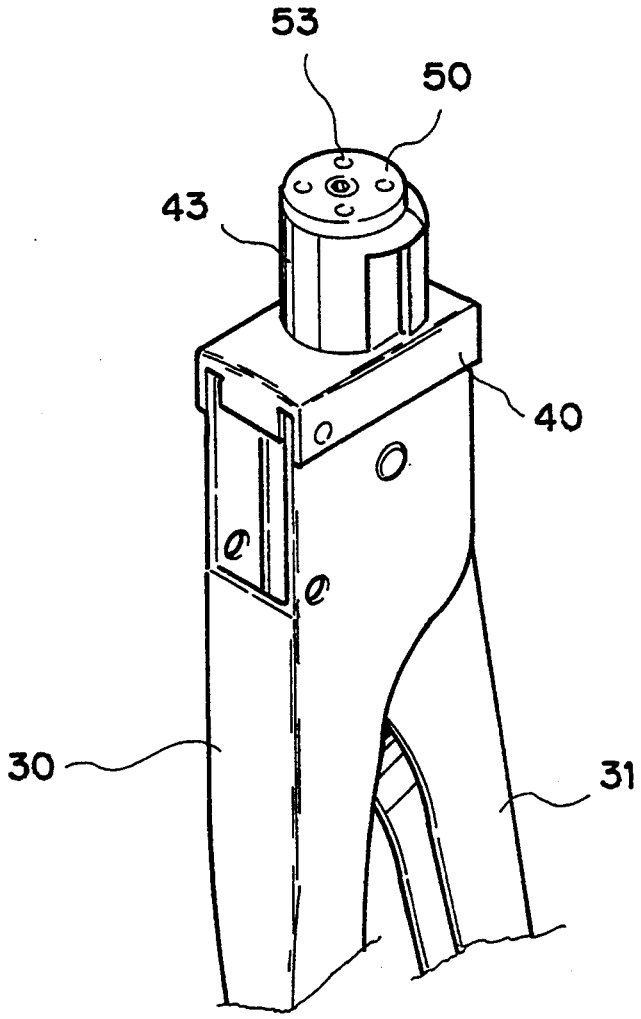
FIG. 5 is a partial perspective view illustrating the operation of the riveter.
Figure 6:
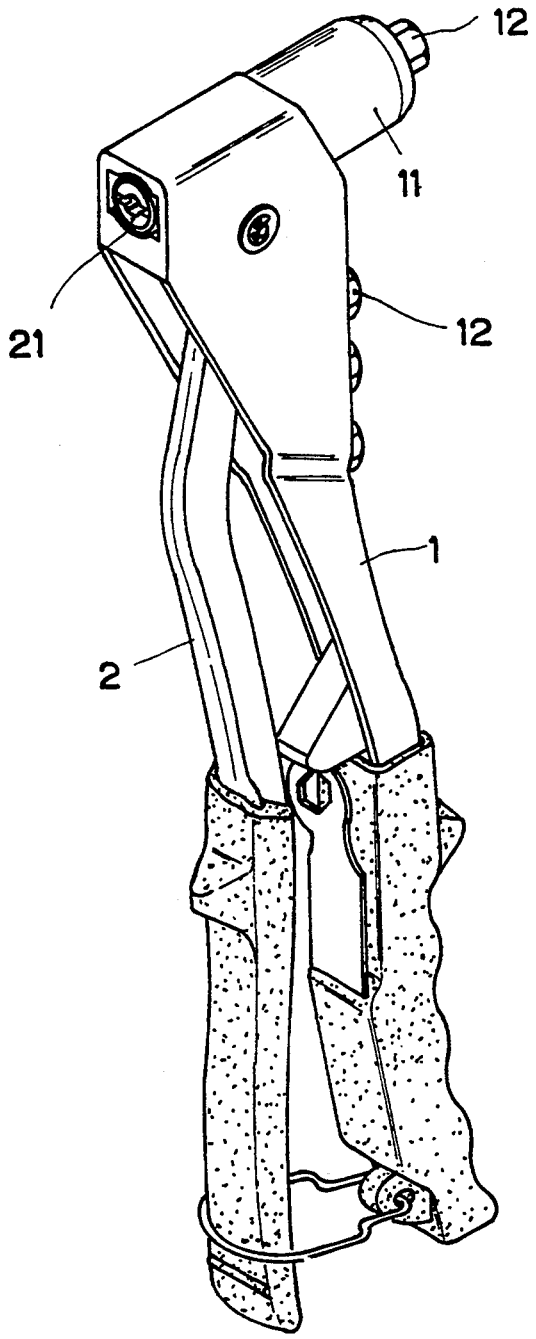
FIG. 6 PRIOR ART
FIG. 6 is a perspective view illustrating a typical riveter.

The body 30 includes two pairs of ears 35, 36, a casing 40 includes two apertures 41 for engaging with either pair of the ears 35, 36 and is fixed to the body by a screw 42, a seat 43 extended from the casing 40, when the apertures 41 are engaged with ears 35 (FIGS. 3 and 4), the seat 43 is perpendicular to the body 30, and when the apertures 41 are engaged with the other pair of ears 36 (FIG. 5), the seat 43 is extended in parallel with the body 30, the seat 43 includes a chamber 44 formed therein for slidably receiving the chuck 32 and includes a free end having an annular groove 45 formed therein and communicated with the chamber 44, a dent 46 formed in the free end of the seat 43 for receiving a projection including a spring 47 and a ball 48, a disc 50 is rotatably secured to the free end of the seat 43 by a screw 51 and includes four cavities 52 formed therein for engaging with the projection 48 such that the disc 50 can be maintained in four positions, and the disc 50 includes four mouths 53 of different sizes provided therein for receiving rivets of different sizes, the mouths 53 are engaged in the annular groove 45 of the seat 43, and either of the mouths 53 can be aligned with the chuck 32 such that the rivets engaged in the mouths can be engaged in the chuck 32, best shown in FIGS. 3 and 4.

Referring again to FIG. 3, it is to be noted that, as conventional, the chuck 32 includes three or four jaws 320 slidably disposed therein which have one end extended outward of the chuck for engaging with either of the mouths 53 when the handle 31 is moved away from the body 30, and the free ends of the jaws 320 include a concave surface formed therein for engaging with the mouths 53 such that the jaws 320 can be moved away from each other or can be opened such that the rivets can be easily engaged into the gap formed among the jaws 320.

Referring next to FIG. 4, when it is required to change the mouth of different size, it is only required to rotate the disc 50 against the biasing force of the projection 47, 48 until the mouth of right size is aligned with chuck 32.

Accordingly, the riveter in accordance with the present invention includes a disc having two or more mouths provided therein, and the mouth can be easily aligned with the chuck when the disc is rotated.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A riveter comprising a body including a first end and a second end, a handle including a first end pivotally coupled to said first end of said body and including a second end movable toward or away from said body, a chuck coupled to said first end of said handle, a casing secured to said first end of said body and including a seat extended therefrom, said seat including a chamber formed therein for slidably receiving said chuck and including an annular groove formed therein distal to said casing, said annular groove being intersected and communicating with said chamber, a disc rotatably secured to said seat and including at least two mouths provided therein, said mouths each including one end engaged in said annular groove for aligning with said chuck when said disc is rotated.

2. A riveter according to claim 1, wherein said seat includes a projection disposed therein, said disc includes at least two cavities formed therein for engaging with said projection such that said disc is retained in position relative to said seat.

* * * * *